US006791202B2

(12) United States Patent
McCullough

(10) Patent No.: US 6,791,202 B2
(45) Date of Patent: Sep. 14, 2004

(54) VEHICLE REMOTE STARTING SYSTEM SHUTOFF

(75) Inventor: Scott A. McCullough, Sterling Heights, MI (US)

(73) Assignee: General Motors Corporation, Detroit, MI (US)

( * ) Notice: Subject to any disclaimer, the term of this patent is extended or adjusted under 35 U.S.C. 154(b) by 143 days.

(21) Appl. No.: 10/001,288

(22) Filed: Nov. 1, 2001

(65) Prior Publication Data

US 2003/0080565 A1 May 1, 2003

(51) Int. Cl.[7] ..... F02N 11/04

(52) U.S. Cl. ..... 290/38 C; 290/38 R; 307/10.6

(58) Field of Search ..... 290/1 R, 34, 36 A, 290/38 C, 37 R, 38 R, 54; 74/6, 7 R; 180/60, 65.1, 167; 123/179 B, 179 BG, 179 R, 179.2, 179.3, 179.4; 307/10.6

(56) References Cited

U.S. PATENT DOCUMENTS

| | | | | | |
|---|---|---|---|---|---|
| 327,876 | A | * | 10/1885 | Hall | 169/20 |
| 3,078,834 | A | * | 2/1963 | Wright | 123/179.2 |
| 3,455,403 | A | * | 7/1969 | Hawthorne | 180/167 |
| 3,507,259 | A | * | 4/1970 | Lankford | 123/179.2 |
| 3,569,724 | A | * | 3/1971 | Kuehn, III | 290/37 R |
| 3,577,164 | A | * | 5/1971 | Re Baratelli et al. | 290/38 C |
| 3,654,481 | A | * | 4/1972 | Ishikawa et al. | 307/10.1 |
| 3,657,720 | A | * | 4/1972 | Avdenko et al. | 290/38 C |
| 3,696,333 | A | * | 10/1972 | Mott | 290/38 D |
| 3,793,529 | A | * | 2/1974 | Bucher | 290/33 |
| 3,927,329 | A | * | 12/1975 | Fawcett et al. | 290/1 R |
| 4,036,040 | A | * | 7/1977 | Graizzaffi | 70/431 |
| 4,080,537 | A | * | 3/1978 | Bucher | 290/38 R |
| 4,131,304 | A | * | 12/1978 | Wagner | 290/38 C |
| 4,227,588 | A | * | 10/1980 | Biancardi | 180/167 |
| 4,236,594 | A | | 12/1980 | Ramsperger | 180/167 |
| RE30,686 | E | | 7/1981 | Bucher | 290/38 R |
| 4,345,554 | A | * | 8/1982 | Hildreth et al. | 123/179.2 |
| 4,392,059 | A | * | 7/1983 | Nespor | 290/38 D |
| 4,446,460 | A | | 5/1984 | Tholl et al. | 340/825.69 |
| 4,482,812 | A | * | 11/1984 | Hori et al. | 290/38 R |
| 4,500,794 | A | * | 2/1985 | Hamano et al. | 290/38 C |

(List continued on next page.)

FOREIGN PATENT DOCUMENTS

| | | | | |
|---|---|---|---|---|
| GB | 2135736 | * | 9/1984 | F02N/5/02 |
| JP | 58106148 | * | 6/1983 | F02D/29/02 |
| JP | 03175149 | * | 7/1991 | F02N/11/08 |
| JP | 06147070 | * | 5/1994 | F02N/11/08 |
| JP | 09021377 | * | 1/1997 | F02N/11/08 |

OTHER PUBLICATIONS

U.S. patent application Ser. No. 10/143,839, Wisnia et al., filed May 2002.*

*Primary Examiner*—Nicholas Ponomarenko
*Assistant Examiner*—Heba Elkassabgi
(74) *Attorney, Agent, or Firm*—Christopher DeVries

(57) ABSTRACT

A remote starting system shutoff system and method for a vehicle includes a vehicle power plant and a remote starting system that is connected to the vehicle power plant. A transmitter actuates the remote starting system to start the vehicle power plant. A vehicle hazard switch in the passenger compartment of the vehicle has first and second positions. When the hazard switch is in the first position, the vehicle power plant can be started using the transmitter. After the vehicle power plant is started, the remote starting system turns the vehicle power plant off if the hazard switch transitions from the first position to the second position. Remote starting is disabled anytime that the switch is in the second position. The transmitter is preferably a radio frequency transmitter. The vehicle power plant is selected from the group of internal combustion engines, diesel engines, hybrids and fuel cells.

18 Claims, 3 Drawing Sheets

U.S. PATENT DOCUMENTS 4,510,396 A * 4/1985 Uchida et al. ..... 290/30 R
4,520,271 A * 5/1985 Goertler et al. ..... 290/38 C
4,577,599 A * 3/1986 Chmielewski ..... 123/179.2
4,598,209 A * 7/1986 Garlinghouse ..... 290/38 C
4,606,307 A 8/1986 Cook ..... 123/179 B
4,674,454 A * 6/1987 Phairr ..... 123/179.2
4,893,240 A * 1/1990 Karkouti ..... 701/2
4,897,554 A * 1/1990 Uehara et al. ..... 290/38 R
4,928,778 A * 5/1990 Tin ..... 180/167
5,000,139 A * 3/1991 Wong ..... 123/179.2
5,024,186 A * 6/1991 Long et al. ..... 123/179.4
5,042,439 A * 8/1991 Tholl et al. ..... 123/179.2
5,054,569 A 10/1991 Scott et al. ..... 180/167
5,095,865 A * 3/1992 Keister ..... 123/179.5
5,146,215 A * 9/1992 Drori ..... 340/5.22
5,157,375 A * 10/1992 Drori ..... 340/429
5,179,920 A * 1/1993 Bender ..... 123/198 DB
5,184,584 A 2/1993 Cantrell ..... 123/179.2
5,451,820 A * 9/1995 Gotoh et al. ..... 307/10.6
5,506,562 A * 4/1996 Wiesner ..... 340/425.5
5,614,883 A * 3/1997 Dery et al. ..... 340/458
5,617,819 A 4/1997 Dery et al. ..... 123/179.2
5,656,868 A 8/1997 Gottlieb et al. ..... 307/10.6
5,673,017 A * 9/1997 Dery et al. ..... 340/426.17
5,689,142 A 11/1997 Liu ..... 307/10.5
5,721,550 A * 2/1998 Lopez ..... 341/176
5,751,073 A * 5/1998 Ross ..... 307/10.5
5,757,086 A * 5/1998 Nagashima ..... 307/10.6
5,838,255 A * 11/1998 Di Croce ..... 340/825.69
5,874,785 A 2/1999 Liu ..... 307/10.5
5,937,065 A * 8/1999 Simon et al. ..... 380/262
5,942,988 A * 8/1999 Snyder et al. ..... 340/825.69
5,955,940 A * 9/1999 Chen ..... 340/426.17
6,028,372 A * 2/2000 West et al. ..... 307/10.6
6,101,428 A * 8/2000 Snyder ..... 701/2
6,147,418 A * 11/2000 Wilson ..... 307/10.6
6,467,448 B2 * 10/2002 Wisnia et al. ..... 123/179.2
6,559,558 B2 * 5/2003 Quesnel et al. ..... 307/10.6
2002/0112688 A1 * 8/2002 Fariz et al. ..... 123/179.2

* cited by examiner

VEHICLE REMOTE STARTING SYSTEM SHUTOFF

TECHNICAL FIELD

The present invention relates to remote starting systems for vehicles, and more particularly to a shutoff system and method for vehicle remote starting systems.

BACKGROUND OF THE INVENTION

Vehicles utilizing internal combustion engines and diesel engines should be started and warmed up before they are driven. Warming the engine is particularly important in cold weather conditions because the vehicles could stall if they are improperly warmed up before driving. In addition, damage to the engine may occur if the engine is run at higher rpms while the engine is cold. In many vehicles, it is advisable to warm the engine for a few minutes before driving. Most drivers fail to allow the engine sufficient time to warm up the vehicle prior to driving. Usually, the vehicle is started and driven immediately. As a result, the life of the engine is reduced.

In cold weather, it is inconvenient for the driver to sit in the cold vehicle as the engine warms up. When leaving for work in the morning, some drivers start the vehicle and leave the vehicle unattended while it is warming up. This practice is inconvenient since the driver must endure the cold weather twice. During the day, if the vehicle is allowed to sit long enough to cool down to the cold outside ambient temperature, drivers often fail to allow the engine to warm up before driving the vehicle again.

Entering a vehicle in hot or cold temperature extremes is an unpleasant experience for the driver and/or passengers. In the heat of summer or the cold of winter, the climate control system may take several minutes to heat or cool the passenger compartment to a comfortable temperature. In cold weather, the vehicle occupants must endure the cold temperatures while the climate control system heats the passenger compartment. In hot weather conditions, the temperature of the compartment often rises significantly higher than the outdoor temperature. The vehicle occupants often begin to perspire before the passenger compartment cools to a comfortable temperature. When frost or fog coats the front or rear windows, it often takes a few minutes until the windows can be cleared. The driver must wait in the vehicle until the car defroster sufficiently clears the windows before driving safely.

In an effort to eliminate some of the above-identified problems, remote starting systems for automobile engines were developed. Representative systems are disclosed in U.S. Pat. No. 4,080,537 to Bucher; U.S. Pat. No. 4,236,594 to Ramsperger; U.S. Pat. No. 4,392,059 to Nespor; U.S. Pat. No. 4,446,460 to Tholl et al; U.S. Pat. No. 4,598,209 to Carlinghouse; U.S. Pat. No. 4,606,307 to Cook; U.S. Pat. No. 5,000,139 to Wong; U.S. Pat. No. 5,054,059 to Scott et al; U.S. Pat. No. 5,184,584 to Cantrell; U.S. Pat. No. 5,656,868, to Gottlieb et al; U.S. Pat. No. 5,617,819 to Dery et al; U.S. Pat. No. 5,689,142 to Liu; and U.S. Pat. No. 5,757,086 to Nagashima.

These systems generally utilize a portable transmitter that is carried by the driver to remotely start the vehicle; however, other devices maybe employed. The transmitter generates a radio frequency signal that is received by a remote starting device that is associated with the vehicle. In more simple systems, such as U.S. Pat. No. 6,147,418 to Wilson, the driver must manually set the defroster, heat or other device prior to leaving the car before the remote start. More complex systems such as U.S. Pat. No. 5,673,017 to Dery et al. allow the climate control system, defroster and other vehicle systems to be indirectly adjusted using the transmitter.

Typically, the transmitter must be located within a certain distance from the vehicle—such as 100–300 yards. The transmitters are either one-way or two-way control systems. One-way systems do not typically provide any indication or feedback to the transmitter regarding the status of the engine and/or the accessories. Two-way systems, such as pager systems, sometimes provide an indication that the engine and/or the accessories have been successfully turned on.

Generally, the transmitter of the remote starting system operates in a manner that is similar to keyless entry systems. When the driver presses a start button on the transmitter, the transmitter generates a start signal that typically includes an encoded start message. The receiver decodes the start message, a controller checks certain conditions (such as whether the vehicle is already running and in park for automatic transmissions), and the controller sends a start signal to an engine control module.

Some of the remote starting systems such as Re. No. 30,686 to Bucher or U.S. Pat. No. 5,942,988 to Snyder et al. can be deactivated or shut off by depressing the brake or opening the hood. Unfortunately, the driver often inadvertently bumps the brake pedal upon entering the vehicle, which turns the vehicle off and requires the vehicle to be restarted. In addition, if a passenger in the vehicle wants to shut off the engine, the brake pedal is not readily accessible from the front or rear passenger seats.

SUMMARY OF THE INVENTION

A remote starting system shutoff apparatus and method according to the present invention for a vehicle includes a vehicle power plant and a remote starting system that is connected to the vehicle power plant. A transmitter actuates the remote starting system to start the vehicle power plant. A switch that is located in the vehicle compartment has first and second positions. When the switch is in the first position, the vehicle power plant can be started using the transmitter. When the switch is in the second position, the vehicle power plant cannot be started using the transmitter. The switch is preferably the vehicle hazard switch.

In other features of the invention, after the vehicle power plant is started, the remote starting system turns the vehicle power plant off if the hazard switch transitions from the first position to the second position. The vehicle power plant is preferably selected from the group of internal combustion engines, diesel engines, hybrids and fuel cells.

A remote starting system shutoff apparatus and method for a vehicle according to another aspect of the invention includes a vehicle power plant and a remote starting system that is connected to the vehicle power plant. A transmitter actuates the remote starting system to start the vehicle power plant. A switch that is located in the vehicle compartment has first and second positions. After the vehicle power plant is started, the remote starting system turns the power plant off if the switch transitions from the first position to the second position. The switch is preferably a hazard switch.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DESCRIPTION OF THE PREFERRED EMBODIMENTS

The following description of the preferred embodiment(s) is merely exemplary in nature and is in no way intended to limit the invention, its application, or uses.

Figure 1:
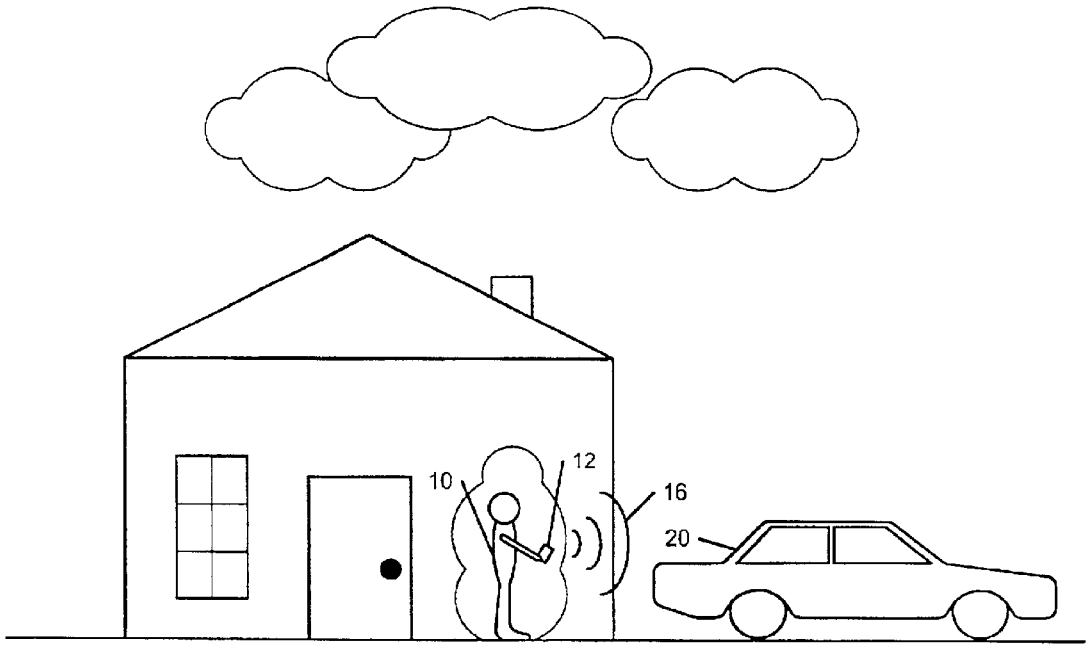
FIG. 1 is a perspective view illustrating the operation of a remote starting system for a vehicle.

Referring now to FIG. 1, a vehicle operator or passenger 10 actuates a transmitter 12 to generate a starting signal 16 that is transmitted to a vehicle 20. The starting signal 16 starts a power plant of the vehicle 20. For example, the transmitter 12 can be actuated from the comfort of the home of the vehicle operator 10.

Figure 2A:
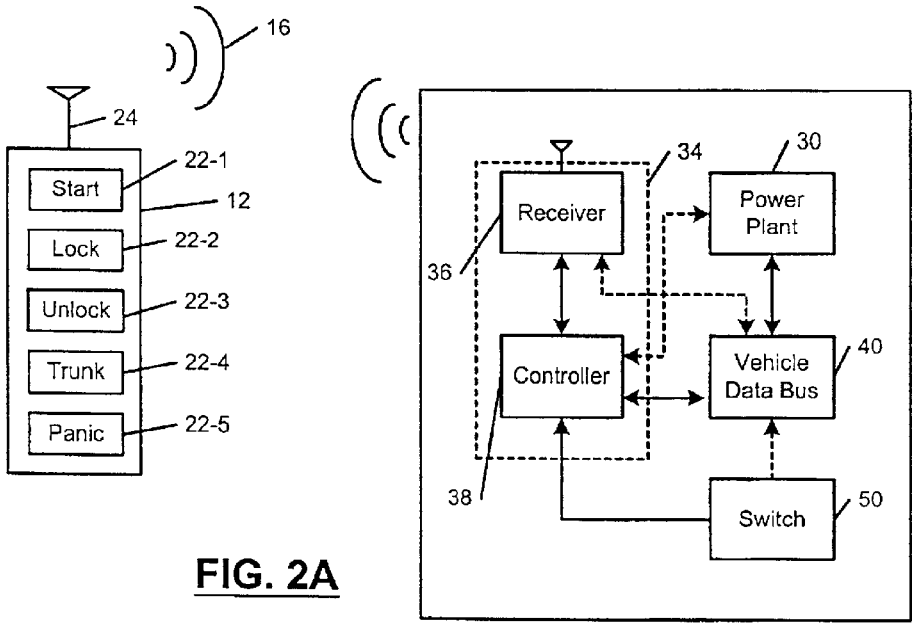
FIG. 2A is a block diagram illustrating a remote starting system for a vehicle that includes a shutoff switch according to the invention.

Referring now to FIG. 2A, for purposes of clarity reference numerals from FIG. 1 have been used where appropriate to identify similar elements. The transmitter 12 is shown to include a start button 22-1 and other keyless entry buttons such as a lock button 22-2, unlock button 22-3, trunk button 22-4, and panic button 22-5. The transmitter 12 typically includes an antenna 24, and the starting signal 16 is a radio frequency signal. Skilled artisans will appreciate that the transmitter may include other buttons, functions, displays, or other input/output interfaces.

Figure 2B:
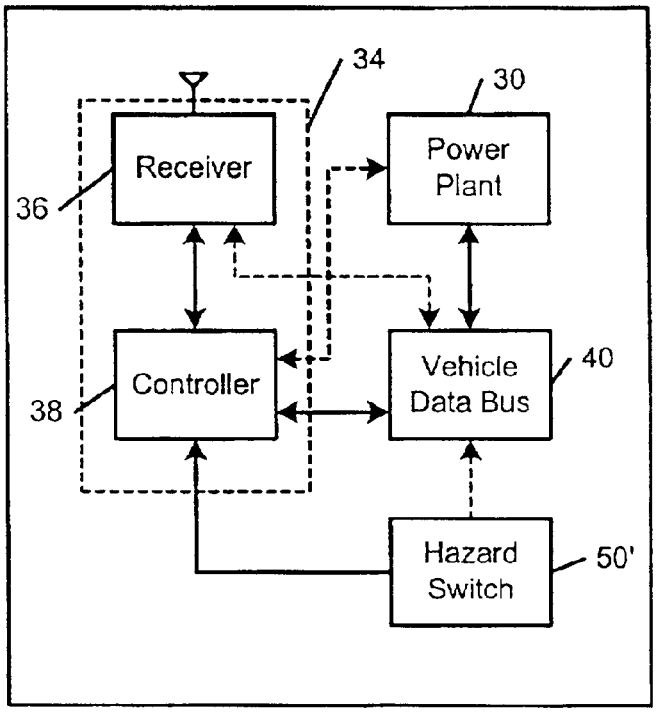
FIG. 2B is a block diagram of the presently preferred remote starting system shutoff for a vehicle that employs the vehicle hazard switch.

The vehicle 20 includes a power plant 30 that is connected to a remote starting system 34. The remote starting system 34 includes a receiver 36 and a controller 38. The controller 38 is preferably connected to a vehicle data bus 40, the receiver 36, and the power plant 30. The vehicle 20 includes a switch 50 that is located in the passenger compartment and is connected to the vehicle data bus 40 and/or to the controller 38. Optional connection methods are shown in dotted lines in. FIGS. 2A and 2B. In a preferred embodiment, the switch 50 is a hazard switch 50' of the vehicle 20 as is shown in FIG. 2B. The switch 50 and the hazard switch 50' preferably have at least two positions or states. The hazard switch 50' is generally used to turn on the hazard lights located on a vehicle, as is known in the art. The hazard switch 50' is typically configured as a two-position pushbutton on the steering column or instrument panel of a vehicle within the vehicle passenger compartment, as is known in the arc. The power plant 20 can be an Internal combustion engine, a diesel engine, a fuel cell, or a hybrid.

Figure 2C:
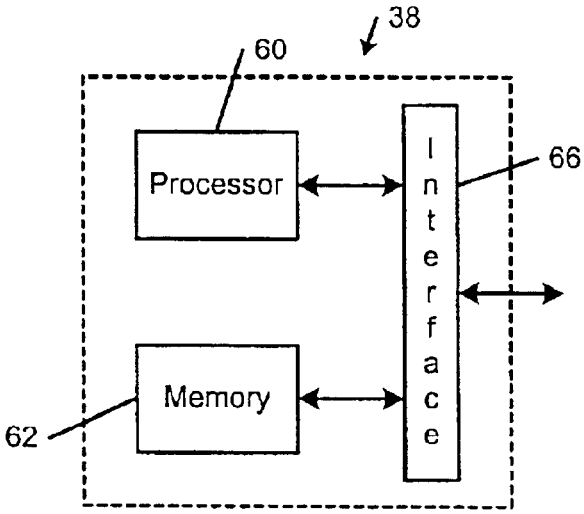
FIG. 2C is a block diagram of a presently preferred controller.

Referring now to FIG. 2C, a presently preferred implementation of the controller 38 is illustrated in further detail and includes a processor 60, memory 62 such as read only memory (ROM), random access memory (RAM), or other suitable electronic storage, and an input/output (I/O) interface 66. The I/O interface 66 is connected to the vehicle databus 40 and/or to the switch 50 or the hazard switch 50'.

Figure 3:
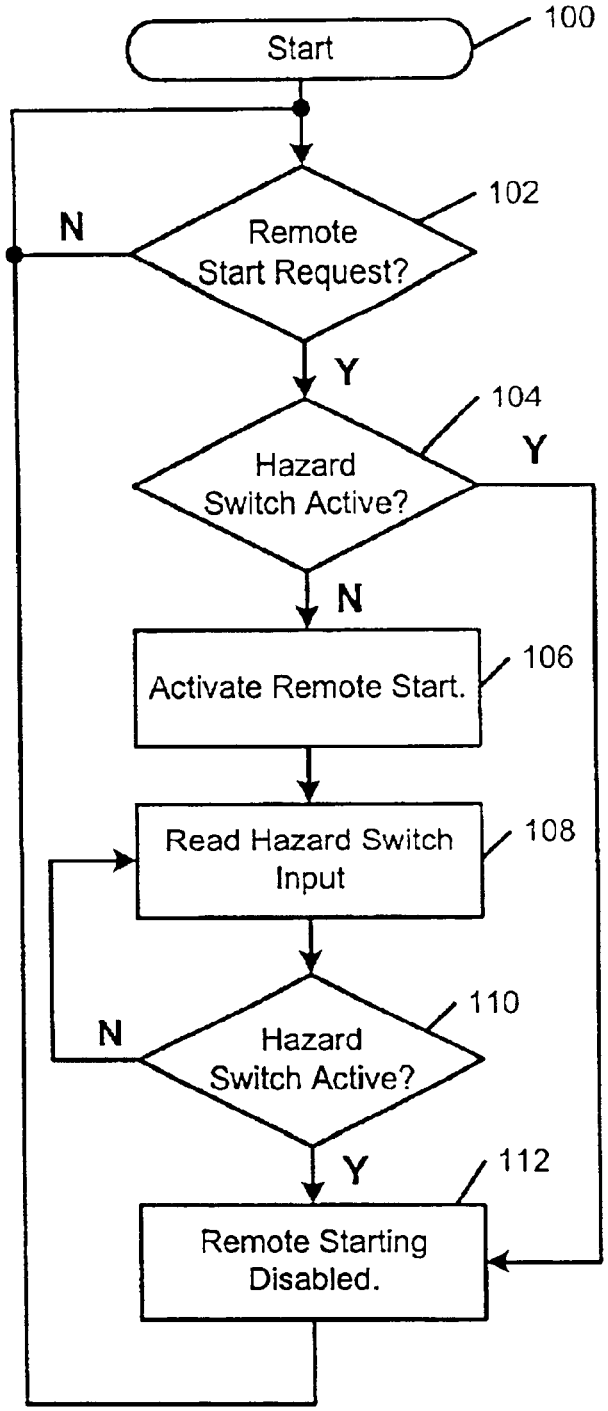
FIG. 3 illustrates steps for disabling the remote starting system via the hazard switch shown in FIG. 1.

Referring now to FIG. 3, steps for operating the controller 38 are illustrated in further detail. Control begins with step 100. In step 102, the controller 38 determines whether there is a remote starting request. Step 102 may be preceded by a determination of whether the power plant 30 of the vehicle 20 is currently running. In a preferred mode, after the remote starting request, the controller 38 runs the vehicle 20 for a first predetermined period (for example, for 10 minutes) and then shuts down the engine. Once the power plant 30 of the vehicle 20 is running, if the remote starting system 34 is triggered again, the controller 38 resets the first predetermined period once (for a maximum of 2× the first predetermined period). The reset mode may be inhibited initially (for example, for 30 seconds) when the first remote starting request is received to prevent false or inadvertent resets.

If the vehicle is not running and a remote starting request has been received, the controller 38 determines whether the switch 50 or 50' is in an active position in step 104. If the switch is not active, control continues with step 106 where the controller 38 activates the remote starting of the vehicle power plant 30. In step 108, the controller 38 reads the status of the switch 50 or 50' either directly or through the vehicle data bus 40. If the switch 50 or 50' is in an active position as determined in step 110, remote starting is disabled and the vehicle power plant 30 is turned off in step 112. If the switch 50 or 50' is not active as determined in step 110, control continues from step 110 back to step 108.

In use, the vehicle operator 10 uses the transmitter 12 to start the vehicle 20 remotely. For example, the vehicle operator 10 starts the vehicle from inside a building or home as is shown in FIG. 1. If the switch 50 or 50' is not active, the remote starting system 34 starts the vehicle power plant 30. When the vehicle operator 10 or passenger wants to shut off the vehicle power plant 30, the vehicle operator 10 or passenger simply toggles the switch 50 or 50' to shut the vehicle power plant 30 off. Still other methods and/or devices for shutting off the engine may be employed in addition to the switch 50 or 50'. If the vehicle operator 10 attempts to start the vehicle using the transmitter 12 while the switch 50 or 50' is active, the remote starting system 34 is deactivated and the transmitter 12 cannot start the vehicle.

As can be appreciated by skilled artisans, the use of the hazard switch 50' in the presently preferred embodiment is a particularly cost-effective mechanism for disabling or shutting off the remote starting system 34'. The hazard switch 50' is easily accessible by both drivers and passengers. The use of the hazard switch 50' provides an existing switch with common operation across all conventional vehicles. The use of the existing switch saves a significant amount of money that would otherwise be spent on a dedicated switch. In addition, the use of the existing hazard switch 50' also eliminates vehicle wiring and interfacing with a controller that would be required for a separate switch.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A remote starting system shutoff for a vehicle, comprising:

a vehicle power plant;

a remote starting system connected to said vehicle power plant;

a transmitter that actuates said remote starting system to start said vehicle power plant; and a vehicle hazard switch that is located in a passenger compartment of said vehicle and has first and second positions, wherein when said hazard switch is in said first position, said vehicle power plant can be started using said transmitter and when said hazard switch is in said second position, said vehicle power plant cannot be started using said transmitter.

2. The remote starting system shutoff of claim 1 wherein after said vehicle power plant is started, said remote starting system turns said power plant off if said hazard switch transitions from said first position to said second position.

3. The remote starting system shutoff of claim 1 wherein said transmitter is a radio frequency transmitter.

4. The remote starting system shutoff of claim 1 wherein said vehicle power plant is selected from the group of internal combustion engines, diesel engines, hybrids and fuel cells.

5. A remote starting system shutoff for a vehicle, comprising:

a vehicle power plant;

a remote starting system connected to said vehicle power plant;

a transmitter that actuates said remote starting system to start said vehicle power plant; and a vehicle hazard switch that is located in a passenger compartment of said vehicle and has first and second positions, wherein after said vehicle power plant is started, said remote starting system turns said power plant off if said switch transitions from said first position to said second position.

6. The remote starting system shutoff of claim 5 wherein when said hazard switch is in said second position, said vehicle power plant cannot be started using said transmitter and when said hazard switch is in said first position, said vehicle power plant can be started using said transmitter.

7. The remote starting system shutoff of claim 5 wherein said transmitter is a radio frequency transmitter.

8. The remote starting system shutoff of claim 5 wherein said vehicle power plant is selected from the group of internal combustion engines, diesel engines, hybrids and fuel cells.

9. A method for remotely starting and shutting off a vehicle, comprising the steps of:

connecting a remote starting system to a vehicle power plant;

actuating said remote starting system using a transmitter to start said vehicle power plant;

coupling a vehicle hazard switch that is located in a passenger compartment of said vehicle and has first and second positions to said remote starting system;

enabling starting of said vehicle power plant using said remote starting system if said hazard switch is in said first position; and disabling starting of said vehicle power plant using said remote starting system if said hazard switch is in said second position.

10. The method of claim 9 further comprising the step of turning said power plant off if said hazard switch transitions from said first position to said second position after said vehicle power plant is started using said remote starting system.

11. The method of claim 9 wherein said transmitter is a radio frequency transmitter.

12. The method of claim 9 further comprising the step of selecting said vehicle power plant from the group of internal combustion engines, diesel engines, hybrids and fuel cells.

13. A method for shutting off a remotely started vehicle, comprising the steps of:

connecting a remote starting system to a vehicle power plant;

actuating said remote starting system using a transmitter to start said vehicle power plant;

coupling a vehicle hazard switch having first and second positions to said remote starting system, wherein said hazard switch is located in a vehicle passenger compartment; and turning said power plant off if said hazard switch transitions from said first position to said second position after said vehicle power plant is started using said remote starting system.

14. The method of claim 13 further comprising the steps of:

enabling starting of said vehicle power plant using said remote starting system if said hazard switch is in said first position; and disabling starting of said vehicle power plant using said remote starting system if said hazard switch is in said second position.

15. The method of claim 13 wherein said transmitter is a radio frequency transmitter.

16. The method of claim 13 further comprising the step of selecting said vehicle power plant from the group of internal combustion engines, diesel engines, hybrids and fuel cells.

17. A remote starting system shutoff for a vehicle, comprising:

a vehicle power plant;

a remote starting system connected to said vehicle power plant;

a transmitter that actuates said remote starting system to start said vehicle power plant; and a manual switch that is located in a passenger compartment of said vehicle and has first and second positions, wherein when said hazard switch is in said first position, said vehicle power plant can be started using said transmitter and when said hazard switch is in said second position, said vehicle power plant cannot be started using said transmitter.

18. The remote starting system of claim 17 wherein the manual switch is mounted on a steering wheel.

* * * * *